US007240871B2

(12) United States Patent
Sotomayor et al.

(10) Patent No.: US 7,240,871 B2
(45) Date of Patent: Jul. 10, 2007

(54) CLEAN-IN-PLACE MILL HOUSING

(75) Inventors: Tom Sotomayor, Streamwood, IL (US); Scott Wennerstrum, Western Springs, IL (US)

(73) Assignee: The Fitzpatrick Company, Elmhurst, IL (US)

( * ) Notice: Subject to any disclaimer, the term of this patent is extended or adjusted under 35 U.S.C. 154(b) by 10 days.

(21) Appl. No.: 10/701,105

(22) Filed: Nov. 4, 2003

(65) Prior Publication Data

US 2004/0251347 A1 Dec. 16, 2004

Related U.S. Application Data

(60) Provisional application No. 60/423,847, filed on Nov. 5, 2002.

(51) Int. Cl.
*B02C 13/284* (2006.01)
*B02C 13/282* (2006.01)

(52) U.S. Cl. ..... 241/285.1; 241/73; 241/285.2; 241/286

(58) Field of Classification Search ..... 241/73, 241/89.2, 89.3, 285.1, 285.2, 286
See application file for complete search history.

(56) References Cited

U.S. PATENT DOCUMENTS

| | | | | |
|---|---|---|---|---|
| 3,196,915 | A * | 7/1965 | Bryant | 241/89.2 |
| 3,756,519 | A * | 9/1973 | Reynolds et al. | 241/73 |
| 3,891,152 | A * | 6/1975 | Guggenheimer | 241/88.4 |
| 6,220,050 | B1 * | 4/2001 | Cooksey | 62/503 |
| 2003/0209616 | A1 * | 11/2003 | Moore, Jr. | 241/21 |

* cited by examiner

*Primary Examiner*—Derris H. Banks
*Assistant Examiner*—Jason Y Pahng
(74) *Attorney, Agent, or Firm*—McDonnell Boehnen Hulbert & Berghoff LLP

(57) ABSTRACT

A clean-in-place housing for use is a material processing mill including a screen inside the mill housing that moved from processing position to cleaning position with a screen carrier without disassembling the housing.

15 Claims, 10 Drawing Sheets

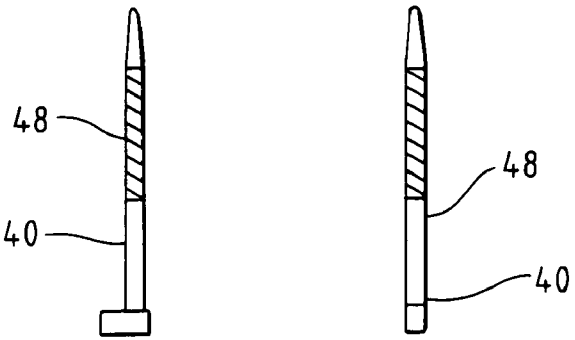
FIG. 4A
FIG. 4B
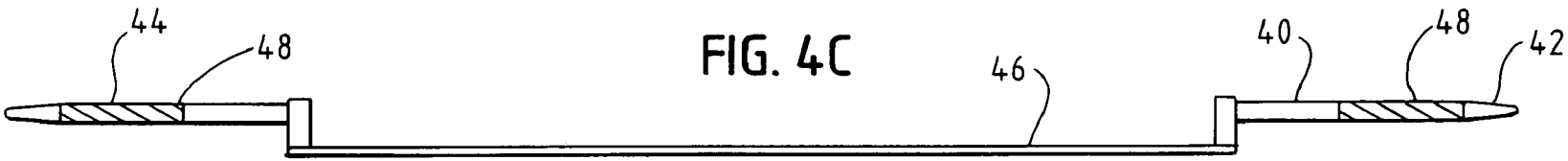
FIG. 4C
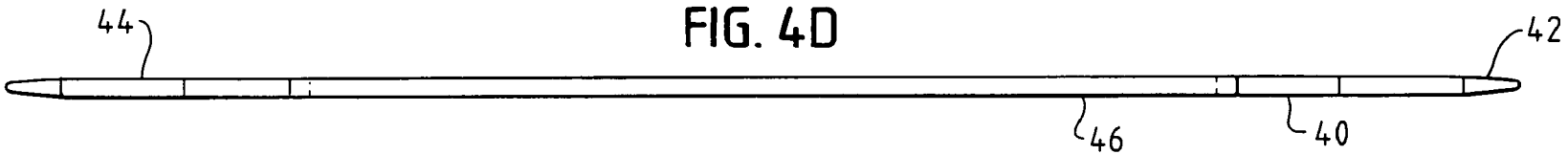
FIG. 4D

CLEAN-IN-PLACE MILL HOUSING

BACKGROUND OF THE INVENTION

This application claims benefit of the filing date of provisional patent application Ser. No. 60/423,847 filed Nov. 5, 2002.

(1) Field of the Invention

This invention concerns a clean-in-place processing mill including a pull-in-place screen as well methods for cleaning a processing mill having a pull-in-place screen. The processing mill of this invention includes a housing having a screen that is movable inside the mill. The screen is moved away from sealing surfaces before cleaning without disassembling the machine thereby facilitating the cleaning of all surfaces with a cleaning fluid. Once cleaning is complete, the screen may be indexed back into position for further processing or the machine may be disassembled an reconfigured.

(2) Description of the Art

The requirement for clean-in-place machinery has become a standard in the food industry and the standard is fast being adopted by the pharmaceutical industry. Clean-in-place machinery allows the processing portions of the machinery to be cleaned without dissembling the machinery thereby providing total containment of the processed materials and the cleaning fluids during the cleaning process. In addition, clean-in-place machinery protects operators from being exposed to hazardous processing materials and cleaning fluids.

Some processing machinery includes screens or other components which are mechanically fastened inside a housing when the equipment is assembled for operation. One problem with such machinery is that processing debris must be removed from all internal machine surfaces during cleaning. For typical processing machinery, this requires disassembling portions of the machinery so that all the machinery surfaces can be cleaned. Disassembling processing mills for cleaning is time consuming and the resulting cleaning process is messy making it very difficult to contain the cleaning fluids.

There is a need therefore, for pharmaceutical and food processing machinery that can be thoroughly cleaned in place without dissembling the processing machinery.

SUMMARY OF THE INVENTION

One aspect of this invention is a clean-in-place housing for use with a material processing mill comprising a housing including a outer face and an inner face defining a processing chamber having an inlet and an outlet wherein the processing chamber includes a flange including a first face and a second face that at least partially defines the perimeter of the housing inner face, the flange having an outwardly angled shoulder associated a flange face and wherein the housing further includes a concave ledge associated with opposing walls of the housing; a concave screen with a perimeter that is complementary to at least a portion of the outwardly angled shoulder of the flange face and that is complementary to the concave ledge; and at least one screen carrier.

Another aspect of this invention is a method for cleaning a clean-in-place housing including a outer face and an inner face defining a processing chamber having an inlet and an outlet wherein the processing chamber includes a flange including a first face and a second face and at least one hole in the flange wherein the flange at least partially defines the perimeter of the inner housing, an outwardly angled shoulder associated a flange face; a concave ledge having a bottom surface associated with opposing housing inner walls; a concave screen having a perimeter that is complementary to the outwardly angled shoulder of the flange face and to the concave ledge bottom; at least one screen carrier that supports the screen having a first end, a second end, and a concave intermediate portion located between the first end and the second end wherein at least one of the screen carrier ends includes a threaded pin that passes through the housing flange hole; and a knob that is threadably engaged with the screen carrier threaded pin wherein the method includes the steps of; (a) unthreading the knob from the screen carrier pin until the screen perimeter becomes disengaged from the outwardly angled shoulder of the housing flange and from the bottom surface of the concave ledge; and (b) cleaning the material processing chamber with a clean-in-place apparatus.

DESCRIPTION OF THE FIGURES

FIGS. 4A-4D are side and front views respectively of screen carriers 40 of a processing mill 10 of this inventions;

FIG. 7A illustrates a processing mill 10 assembled and ready for processing and where FIG. 7B illustrates a processing mill 10 ready for cleaning-in-place;

DESCRIPTION OF THE CURRENT EMBODIMENT

The present invention relates to a clean-in-place housing useful in material processing mills as well as processing mills including clean-in-place housings of this invention. The present invention further includes methods for cleaning material processing mills in place without externally disassembling processing chamber components such as the screen or impeller.

Embodiments of a clean-in-place processing mill housing as well as a processing mill including a clean-in-place housing of this invention are shown in FIGS. 1-9. The present invention will be described with reference to the embodiments shown in FIGS. 1-9. However, the scope of the current invention is not to be limited by the embodiments depicted in the Figures.

Figure 1A:
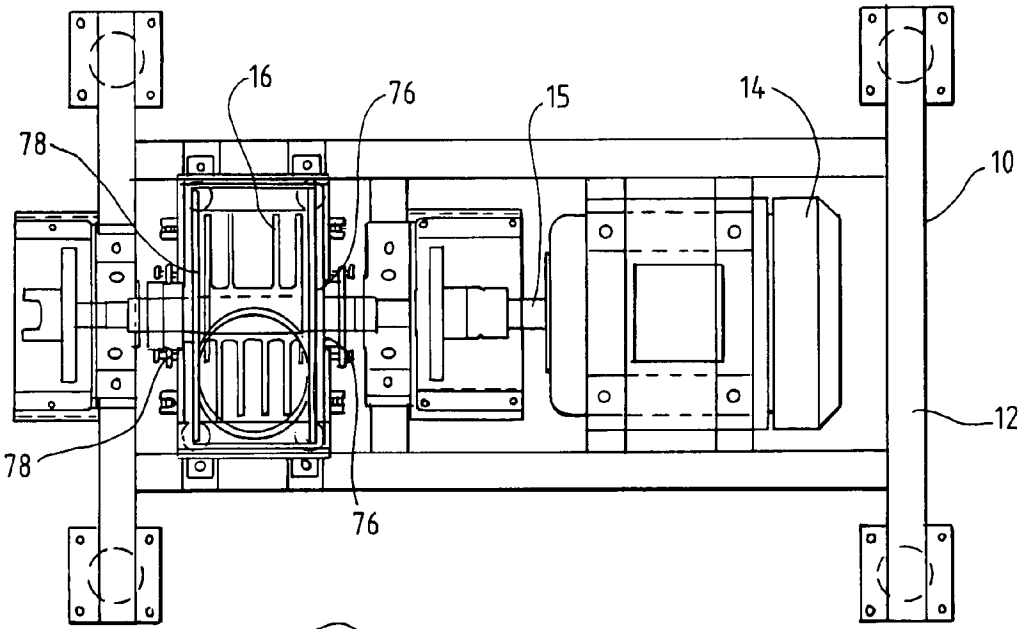
FIGS. 1A and 1B are top and side views respectively of a clean-in-place processing mill of this invention.
Figure 1B:
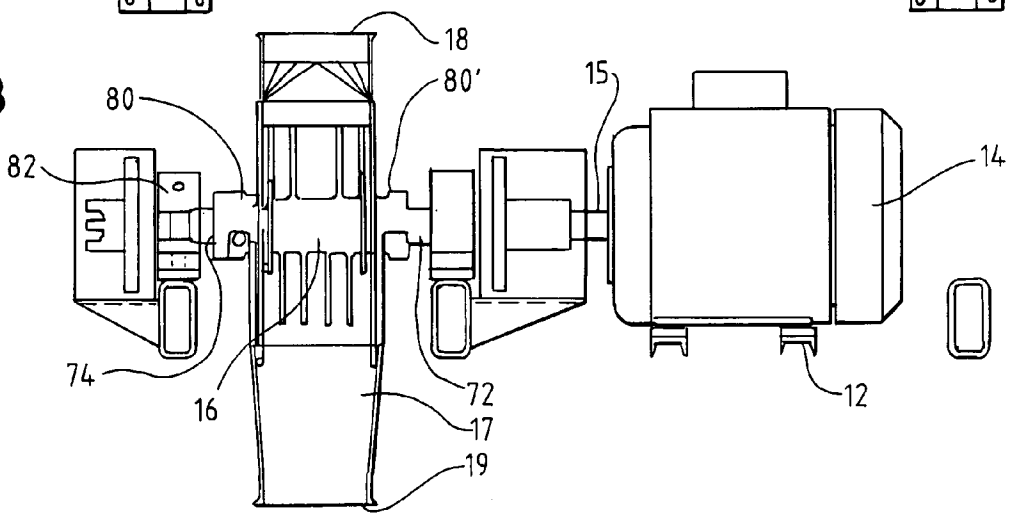

FIGS. 1A and 1B are top and side views of a material processing mill including a clean-in-place housing. Material processing mill 10 will generally include several primary components including a base 12, a motor 14 that is secured to base 12. A housing 17 which includes an inlet 18 and an outlet 19 and further including an impeller 16 located inside housing 17. Impeller 16 includes a first end portion 72 and a second end portion 74 wherein first end portion 72 passes through first housing aperture 76 and through seal 80 and is associated drive shaft 15 which is further associated with motor 14. Impeller second end portion 74 passes through second housing aperture 78 and associated seal 80' where it is associated with floating bearing assembly 82 outside of housing 17. Seals 80 and 80' are preferably gas purged lip seals. Lip seals 80 or 80' are orientated in such a manner that the gas purge is directed into the assembled mill housing thereby preventing materials inside the mill housing from exiting the mill housing through the lip seals. Any gas may be used to purge lip seals 80 and 80'. However, it is preferred that nitrogen is used to purge the seals so that the mill housing is blanketed with an inert gas during processing.

Motor 14 rotates the drive shaft 15 thereby rotating impeller 16. Impeller 16 is reversible. Impeller first end portion 72 or second end portion 74 may be associated with drive shaft 15. This feature of impeller 16 is useful when the impeller includes a hammer surface and a knife surface on the same blade so that the operator can choose to process the material in the mill with the hammer or blade portions of the impeller. In addition, impeller 16 can be directly united with drive shaft 15 or it may be indirectly connected to drive shaft 15 with a belt.

Impeller 16 may be associated with housing 17 at both a first housing aperture 76 and second housing aperture 78. Alternatively, impeller 16 may be cantilevered such that it passes through first housing aperture 76 and second housing aperture 78 is omitted. The choice of impeller support is impacted by a variety of factors including the expected impeller rotation speed. Typically, impeller 17 will be cantilevered when the impeller is expected to operate only at low speeds. When impeller 17 is expected to operate at a variety of speeds including high speeds, then supporting impeller 17 at two ends is desirable but not required.

The processing mill operates by directing a solid or semi-solid material into housing inlet 18 while impeller 16 is rotating. The rotation of impeller 16 against screen 50 controllably reduces the size of material being directed into processing mill 10. The size-reduced material passes through a sized screen 50 and out of processing mill 10 through housing outlet 19.

An important aspect of this invention is the clean-in-place housing. FIGS. 2A-2D show throat chamber 22 of a clean-in-place housing 17 while FIGS. 3A-3C show various views of processing chamber 30 of housing 17. Throat chamber 22, shown in FIGS. 2A-2C, includes an inner face 21 and an outer face 23 defining an inlet 18 and a bottom opening 27 complimentary to a top opening 29 of processing chamber 30. Throat chamber 22 further includes a flange 24 including a first face 33 located outside processing chamber 30 and second face 35 located inside processing chamber 30 and associated with at least a portion of the perimeter of throat chamber 22 defining bottom opening 27. Flange 24 may alternately define top opening 29 of processing chamber 30.

Flange 24 further includes an outwardly angled shoulder 26 associated with flange first face 33. Outwardly angled shoulder 26 provides a site where at least a portion of the penmeter 52 of screen 50 becomes sealed against housing 17. Therefore, outwardly angled shoulder 26 may not necessarily be a continuous shoulder but may be present only where a screen seal is necessary.

Throat chamber 22 includes additional features that facilitate the positioning of a screen 50 in throat chamber 22. Throat chamber 22 includes a concave ledge 37 associated with at least one and preferably with two opposing walls of throat chamber 22. Concave ledge 37 includes a bottom face 43 against which a screen is pulled and held in place during material processing. Throat chamber 22 further includes at least one but preferably two stop pins 39 for each screen carrier 40 used in clean in place housing.

Flange 24 of throat chamber 22 further includes tabs 38 that may include slots 25 or holes. Slots 25 provide a location where a swing-bolt and nut or some other similar device can be used to secure the perimeter of bottom opening 27 of throat chamber 22 to top opening 29 of processing chamber 30. When united, throat chamber 22 and processing chamber 30 form processing housing 17 including inlet 18, outlet 19 and chamber 34. Flange 24 also includes one or more holes 31. The purpose of holes 31 will be explained below.

When throat chamber 22 is united with processing chamber 30, outwardly angled shoulder 26 of flange 24 is located inside processing chamber 34. FIGS. 4A-4C, 5A-5C and 6A-6B and 8A-8C depict components of clean-in-place housing 17 that will be discussed below. FIGS. 4A-4D and 8A-8C are directed to preferred screen carriers 40 of this invention. The purpose of screen carrier 40 is to secure screen 50 into place against outwardly angled shoulder 26 when the processing mill is in use. Screen carrier 40 also allows screen 50 to be indexed away from outwardly angled shoulder 26 during cleaning. Screen carrier 40 includes a first end 42 and second end 44. Screen carrier 40 further includes an intermediate portion 46 located between first end 42 and second end 44. Screen carrier 40 shown in FIGS. 8A-8C include a plurality of intermediate portions 46 that are curved complimentary to the shape of curve of screen 50. Moreover, screen carrier 40 shown in FIGS. 8A-8C includes a first support 41 and a parallel second support 45. Screen carrier first end 42 and second end 44 are pivotally associated with first and second supports 41 and 45 and are located at essentially the center of each respective support. Moreover, the of intermediate portions are fixedly or pivotally associated with first support 41 and second support 45. Intermediate portion 46 of screen carrier 40 shown in FIGS. 4C and 4D are straight. When used, however, intermediate portion 46 will be bent or urged into a concave shape that is complementary to the concave shape of screen 50 and concave ledge 37.

At least one end of screen carrier 40 must be reversibly associated with housing 17. Therefore, one end of screen carrier 40 may be permanently attached to housing 17 while the other end of screen carrier 40 may be reversibly associated with housing 17. In a preferred embodiment, both first end 42 and second end 44 of screen carrier 40 are reversibly united with housing 17 meaning that screen carrier 40 can be completely disassociated from housing 17. In a preferred embodiment, first end 42 and second end 44 are pins 48 that include a threaded portion that pass through holes 31 in flange 24.

Figure 2B:
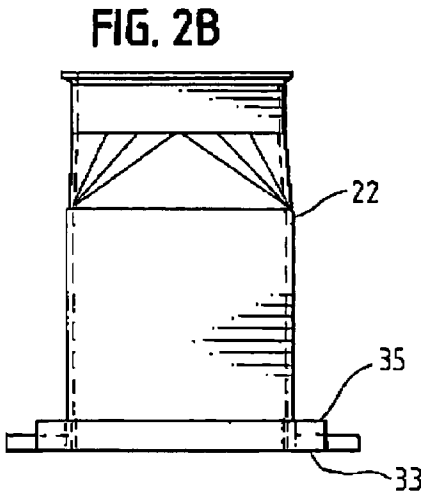
FIGS. 2A, 2B and 2C are top, side, and end views of the mill throat 20 of a processing machine of this invention.
Figure 2D:
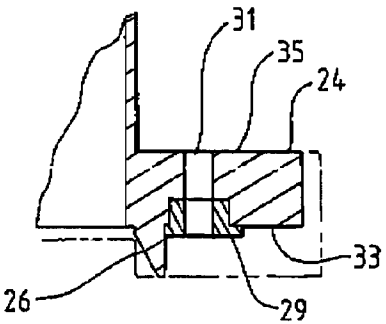
FIG. 2D is a detail showing a flange 24 including an outwardly angled shoulder 26 associated with at least a portion of the bottom perimeter of mill throat 20.
Figure 2A:
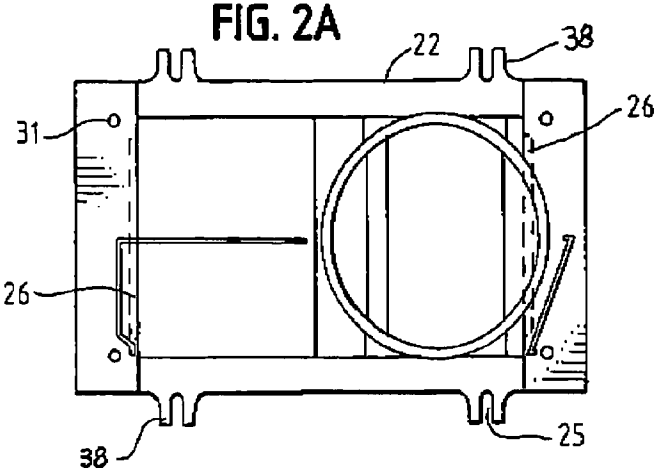
Figure 2C:
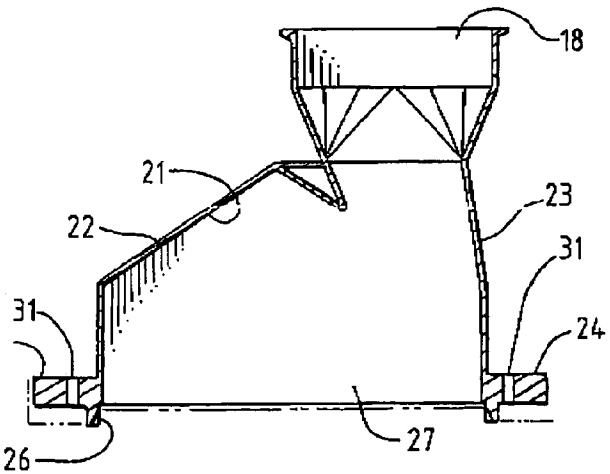
Figure 3B:
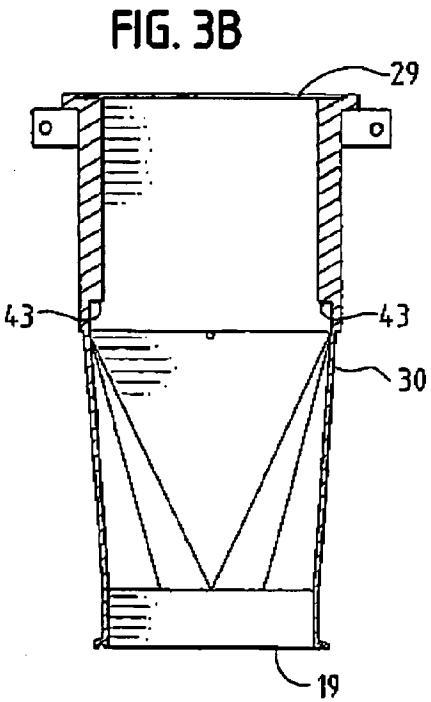
FIGS. 3A, 3B and 3C are top, side cutaway, and end views respectively of processing chamber 30 of a size reduction machine of this invention.
Figure 3A:
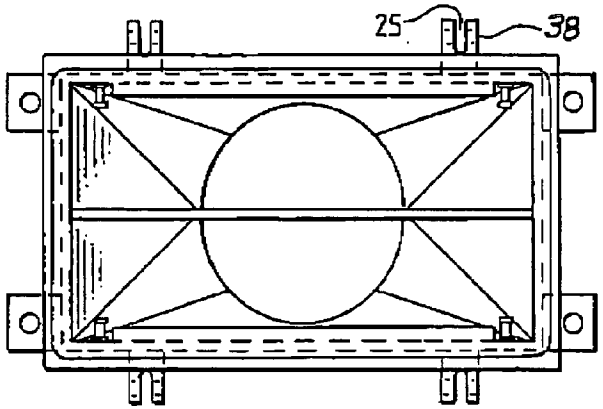
Figure 3C:
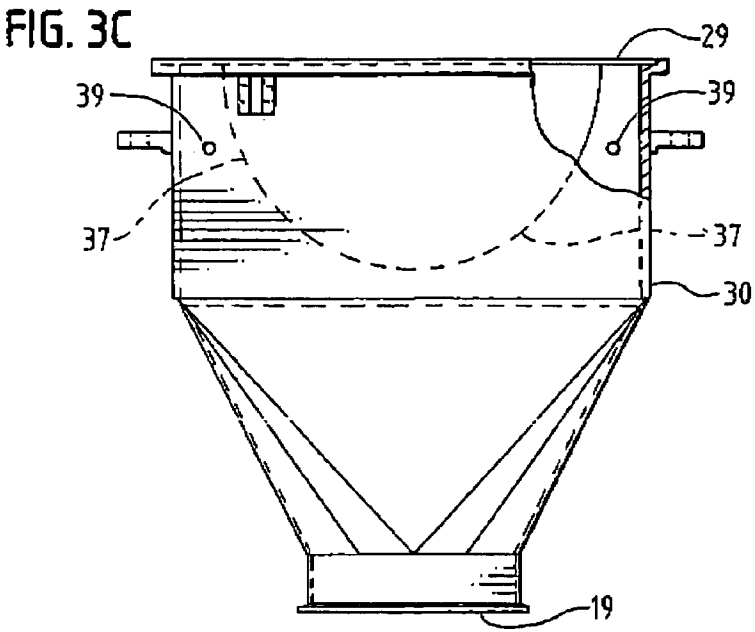

Hole 31, shown in FIG. 2D for example, preferably includes a wiper lip seal 33 located in at least a portion of hole 31. Wiper lip seal 33 forms a central aperture with a center that is complementary to the center of hole 31. Wiper lip seal 33 forms a seal around pin ends 42 and 44 thereby preventing material being processed in the mill housing from exiting the housing through hole 31 either during processing or during cleaning. The screen carrier of this invention allows a screen to be indexed into a sealed contact with the mill housing during processing thereby preventing material from bypassing the screen during the processing. Moreover, the screen holder can be indexed to move the screen away from index out of sealed contact with the mill housing thereby allowing the entire mill housing—both the housing above the screen and below the screen—to be cleaned in place without disassembling.

Figure 5A:
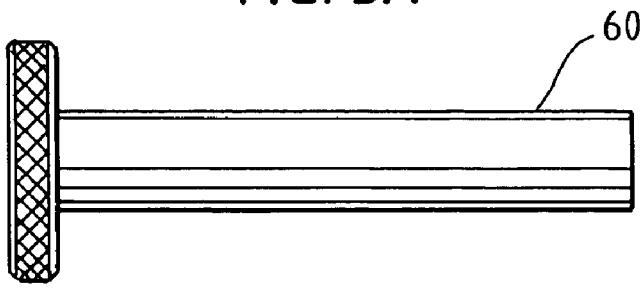
FIGS. 5A, 5B and 5C are side, end, and side cut-away views respectively of a hand knob 50 which is associated with a screen carrier 40.
Figure 5B:
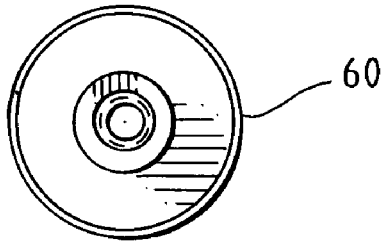
Figure 5C:
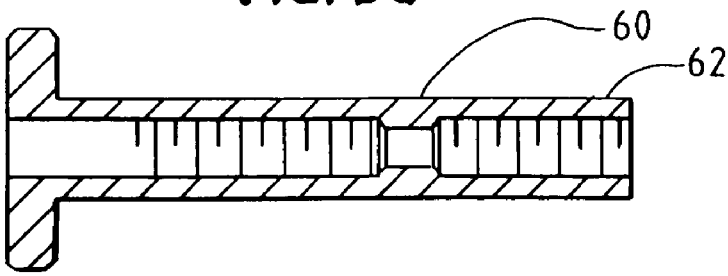

FIGS. 5A-5C are side end and side cut away views respectively of a knob 60 that is associated with one or more preferred thread pins 48 comprising first end 42 and/or second end 44 of screen carrier 40. Knob 60 includes a threaded portion 62 that is complimentary to threaded pin 48. In one embodiment of this invention, pins 48 united with knob 60 in such a manner that tip 61 of pin 48 is flush of knob 60 when screen holder 40 is securely in position.

Figure 6A:
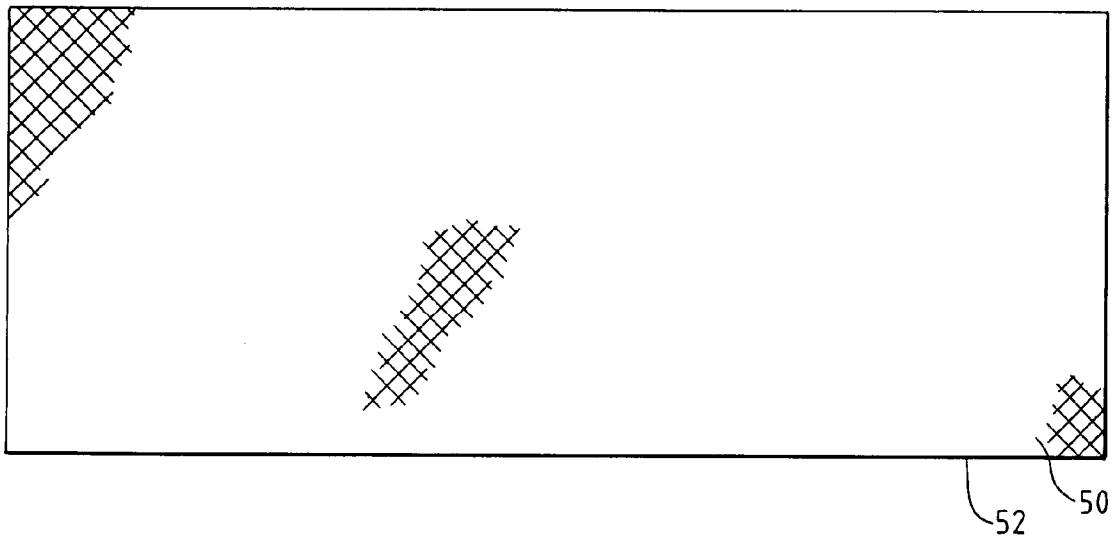
FIGS. 6A and 6B are top and side views of a screen 60 of a processing mill of this invention.
Figure 6B:
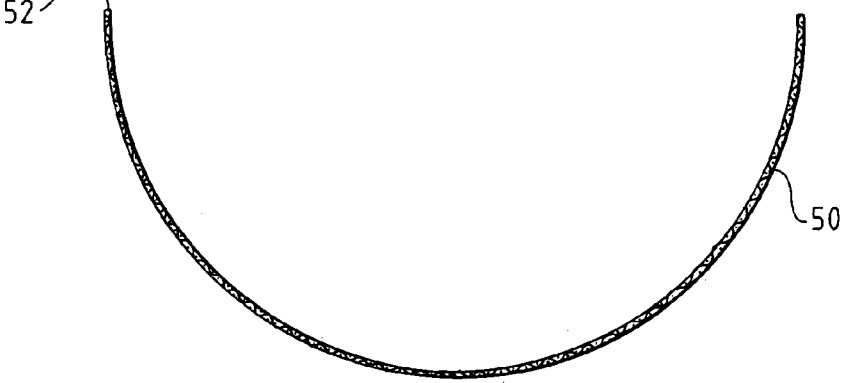

FIGS. 6A-6B are top and end views respectively of a screen 50 including a perimeter 52. Screen 50 will include perforations of a particular gauge to provide the correct size for the processing mill product. Processing mill 10 of this invention is designed so that screen 50 can be interchanged so that the screen gauges can be altered for changing product size specifications. Screen 50 shown in FIGS. 6A and 6B is a concave screen that has a radius that is slightly larger than the radius of impeller 16. This allows the impeller to work in conjunction with the screen to produce a properly sized product material.

In one embodiment of this invention, screen 50 is tack welded to screen holder 40, such as the screen holder shown in FIGS. BA-BC. Screw 50 is tack welded in multiple locations on the plurality of intermediate portions 46 to form a screen/screen bolder combination that is strong and that eliminates the need for a backing to support screen 50.

Figure 7B:
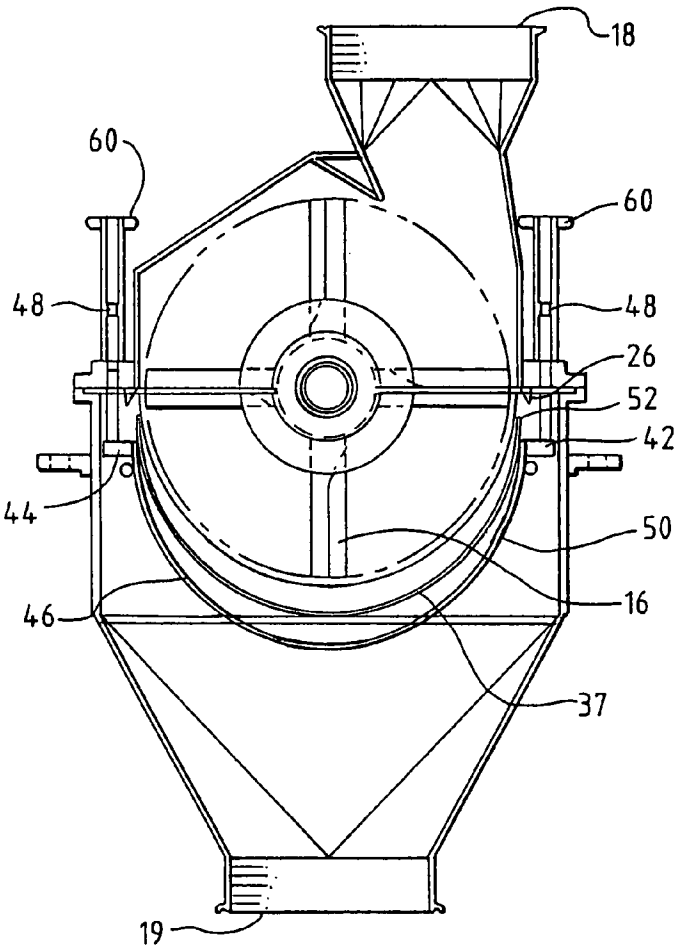
FIGS. 7A and 7B are side cut-away views of the processing section of a processing mill 10 of this invention where
Figure 7A:
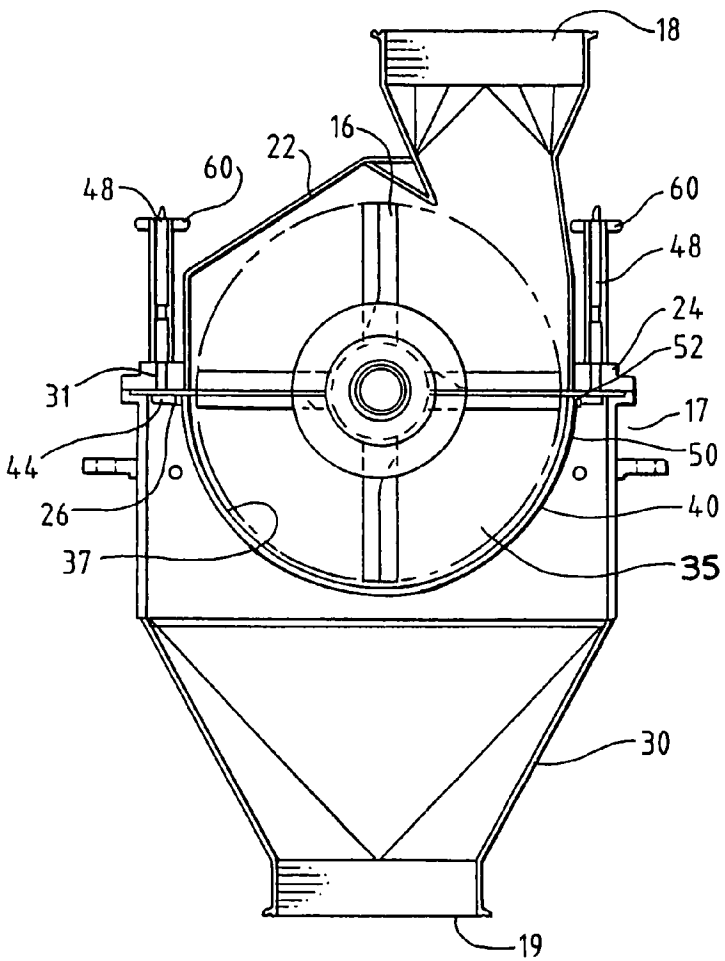

FIG. 7A is a side cross-section view of a clean-in-place housing 17 of this invention wherein the screen is positioned for material processing. FIG. 7B is a side cross section view of clean-in-place housing 17 of this invention as it would appear during a clean-in-place procedure. In FIG. 7A, a portion of perimeter 52 of screen 50 is held securely in place against outwardly angled shoulder 26 by intermediate portion 46 of screen carrier 40. Additionally, the concave portion of screen 50 is pulled into place against bottom surface 43 of concave ledge 37 by screen carrier 40 so that screen 50 forms a seal against concave ledge 37. Concave ledge 37 and outwardly angled shoulder 26 perform the optional function of positioning screen 50 relative to impeller 16 such that the gap between screen 50 and impeller 16 is essentially the same across the entire screen surface.

Screen 50 is held in place by screen carrier 40 by directing threaded pins 48 through holes 31 in flange 24. Next, knob 60 is threaded into threaded pin 48 and knob 60 is turned until screen carrier 40 pulls screen perimeter 52 into secure contact with outwardly angled shoulder 26. As previously mentioned, one end of screen carrier 40 may be irreversibly associated with flange 24. However, in a preferred embodiment shown in FIG. 7A, screen carrier 40 includes threaded pin 48 associated with first end 42 and second end 44 of screen carrier 40. The Figures depict one possible embodiment for uniting screen carrier 40 with flange 24. It is anticipated that screen carrier will be united with flange 24 by device, such pneumatic or electrical cylinders that can be automatically actuated to index screen carrier towards or away from concave ledge 37.

FIG. 7B is a side cross section view of clean-in-place housing 17 as it would look prior or during cleaning. In order thoroughly clean housing 17, perimeter 52 of screen 50 must be moved out of contact with outwardly angled shoulder 26 and concave ledge 37 in order to allow all portions of processing material chamber 34 of housing 17 to be cleaned in place. Screen 50 is disengaged from outwardly angled shoulder 26 and concave ledge 37 by turning knob 60 in a manner that slowly disengages threaded pin 48 from knob 60 thereby allowing screen carrier 40 and intermediate portion 46 to move away from flange 24 and concave ledge 37. As screen carrier 40 moves away from flange 24 and concave ledge 37, perimeter 52 of screen 50 also moves away from outwardly angled shoulder 26 and concave ledge 37 by the force of gravity thereby creating a gap between screen 50 and the outwardly angled shoulder 26 and concave ledge 37 cleaning surfaces. Screen carrier 40 further secures screen 50 in a desired horizontal position for cleaning. Once cleaning is complete, knob 60 is threaded into threaded pin 48 thereby indexing first end 42 and second end 44 of screen carrier 40 towards flange 24 until perimeter 52 of screen 50 is once again engaged with outwardly angled shoulder 26 and concave ledge 37.

During processing materials in the mill of this invention, fines and other processing debris will become distributed over the internal mill parts. All internal surfaces of the machine must be periodically cleaned and/or they must be cleaned when the material being processed in the mill is changed. Moreover, during processing in the mill of this invention, material cannot bypass the screens because the screens are pulled and sealed in place. Therefore, during cleaning, there must be a way for the material to bypass the screens. The mills of this invention allow for materials to bypass the screen during cleaning by lowering the screen away from the sealing surfaces and thereby allowing all surfaces to be exposed to cleaning solutions.

Figure 8A:
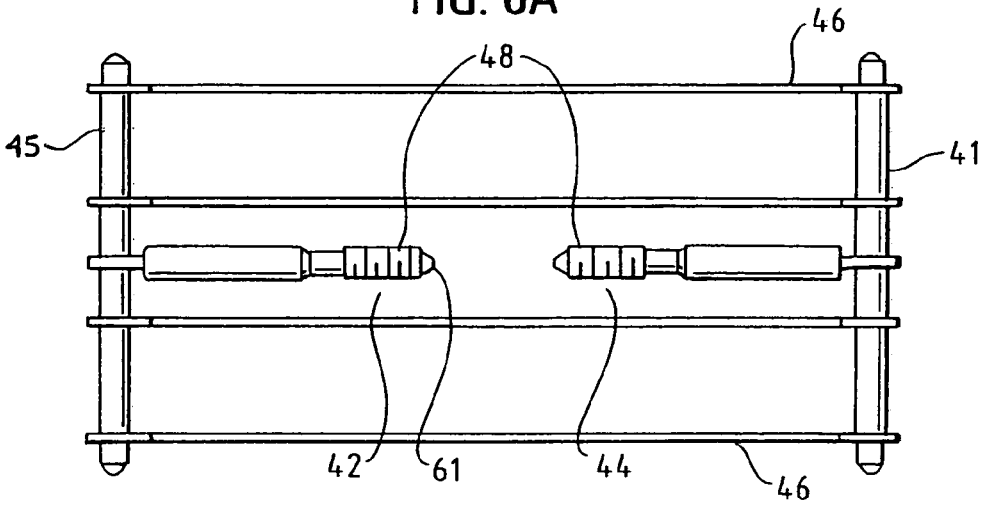
FIGS. 8A, 8B and 8C are top, end, and side views of a screen carrier embodiment of this invention.
Figure 8B:
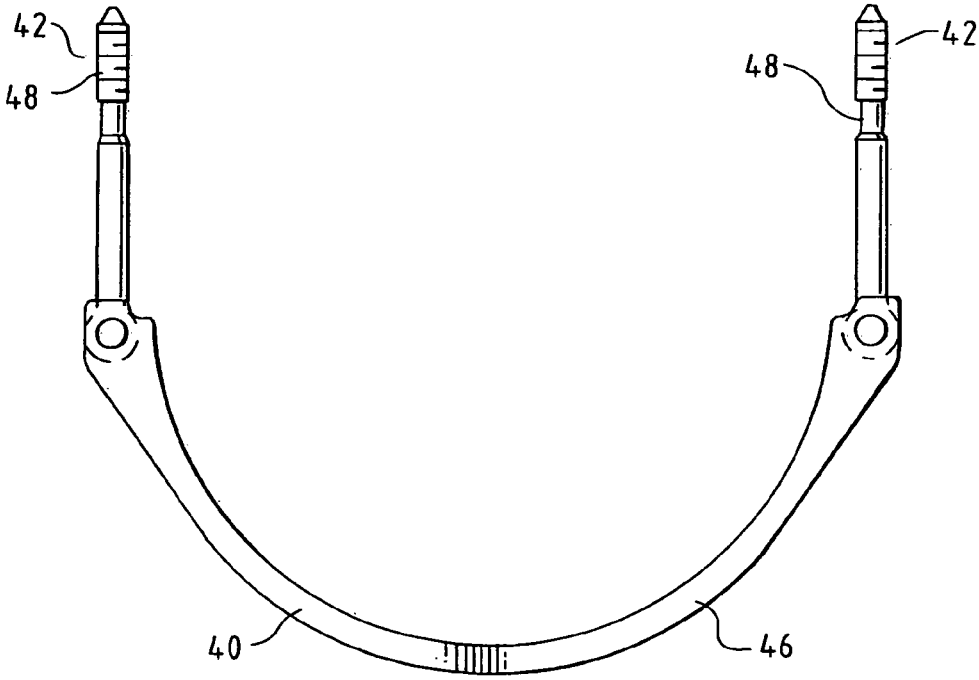
Figure 8C:
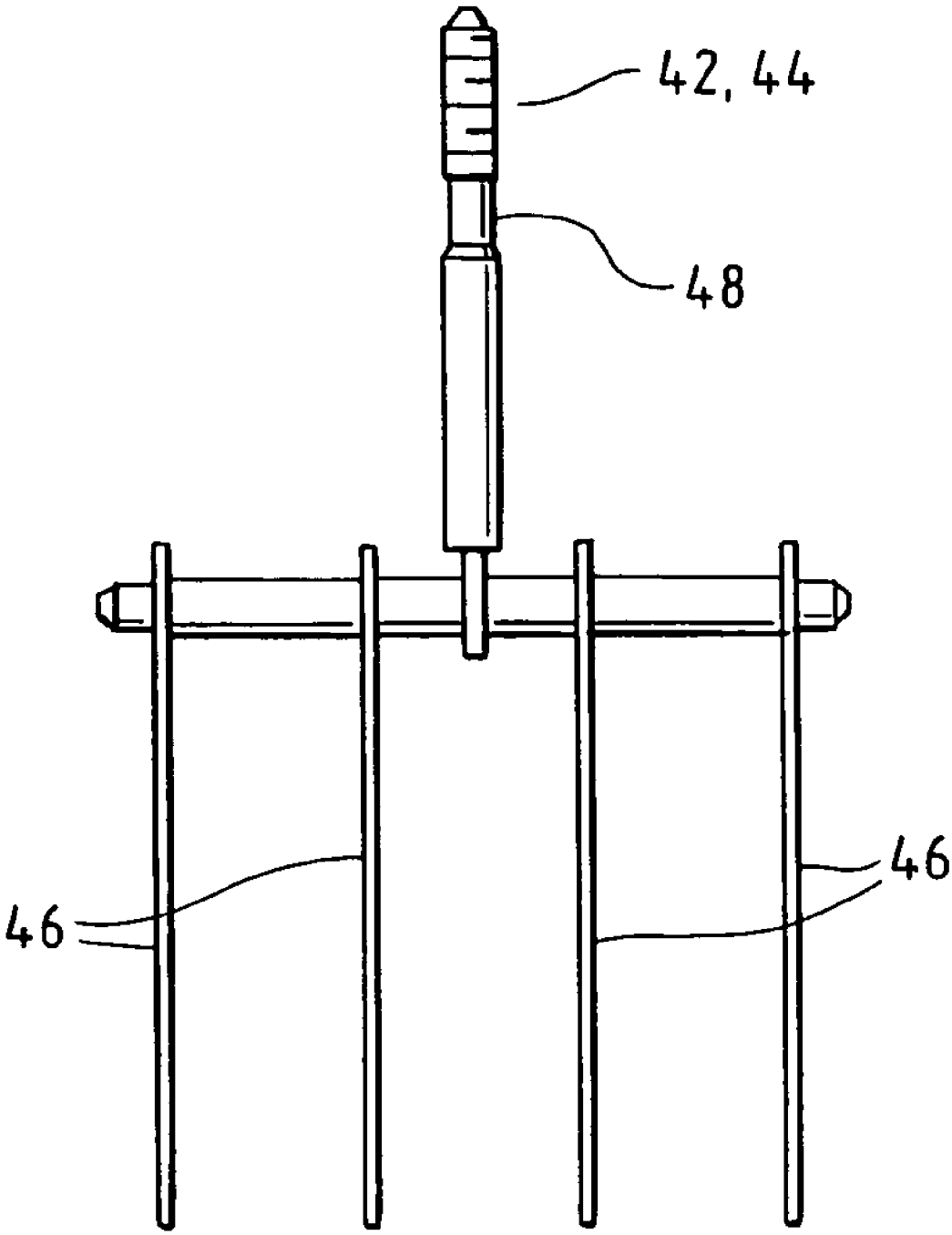
Figure 9B:
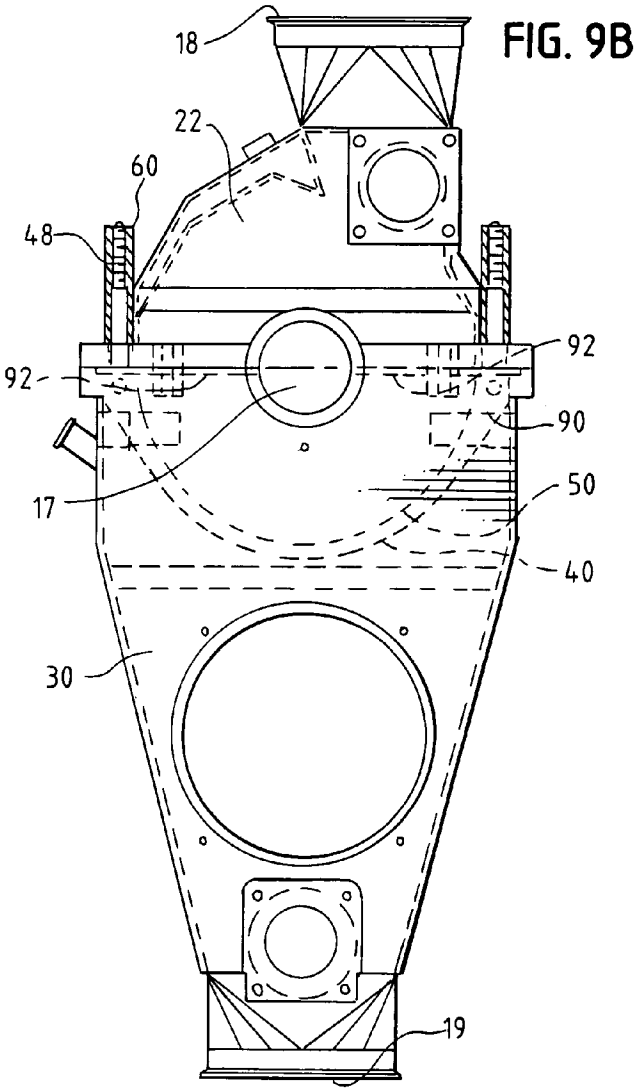
FIGS. 9A and 9B are side and end views of a clean-in-place mill housing embodiment including the screen carrier embodiment of FIGS. 8A-8C.
Figure 9A:
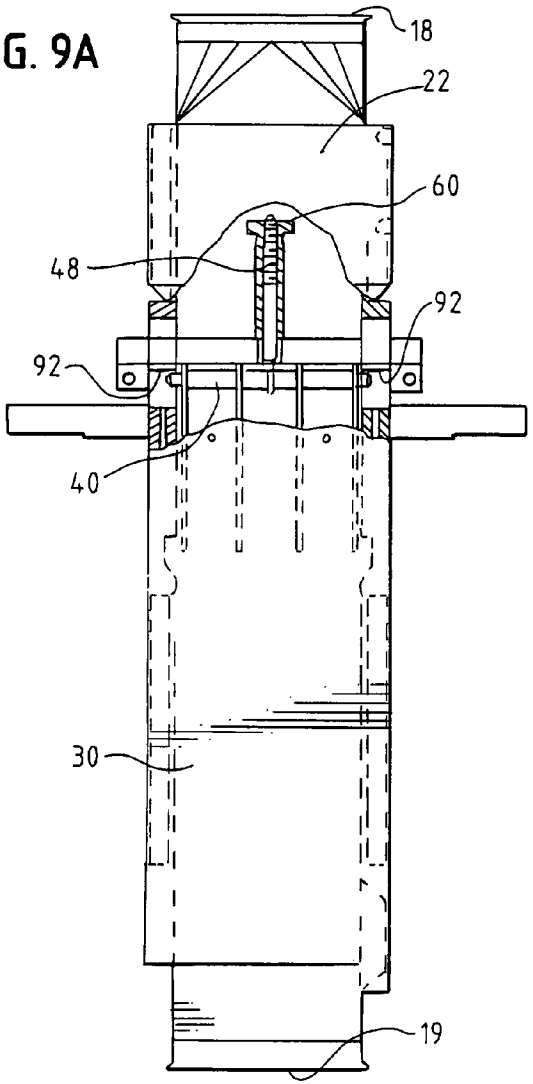

FIGS. 9A and 9B are directed to an embodiment of a clean in place mill housing of this invention including screen holder 40 shown in FIGS. 8A-8C. The mill housing shown in FIGS. 9A and 9B further includes a ledge 90 on which screen carrier supports 41 and 45 rest when screen carrier 40 is indexed away from impeller 17 during clean in place processing. Another optional feature shown in FIGS. 9A and 9B are gaskets 92 located between throat chamber 22 and processing chamber 30. Gaskets 92 are preferably captured gaskets. That is they are flush mounted with a lip on the internal or on the external side to allow the gasket to be positioned properly and that also prevent the gasket from being extruded from the flange or from becoming displaced during processing. Preferably, the inside face of gaskets 92 are flush with the face of the inside chamber flange.

Clean-in-place housing 17 may be cleaned using any clean-in-place process known in the prior art. One example of a clean-in-place system for cleaning fixed processing equipment is described in U.S. Pat. No. 6,161,558, the specification of which is incorporated herein by reference. In one embodiment, the mill housing of this invention can be cleaned using rotary spray nozzles associated with one or more hoses. In this embodiment, separate ball vales (not shown) are attached to the outside mill throat 20 and processing chamber in a manner that allows a rotating spray nozzle to be passed through the ball valve and into the respective processing chambers during cleaning. In order to accomplish this, the ball valve handle and inlet are located outside of the chambers. Finally, the ball valve inlet (not shown) may include an attaching mechanism such threads or a flange that provides a location where the hose that includes a rotating spray nozzle may be temporarily attached to the ball valve inlet to provide a seal during cleaning. Once the rotating spray nozzle are placed through each of the ball valves and located inside the material chambers, fluid is directed through the rotating nozzles thereby cleaning all internal surfaces of the mill housing.

What is claimed is:

1. A clean-in-place housing for use with a material processing mill comprising:

a. a housing including an outer face, an inner face, an inlet and an outlet that together form a housing chamber;

b. a housing flange that at least partially defines the perimeter of the housing inner face, the housing flange having a first face located outside of the housing chamber, a second face located in the housing chamber and an outwardly angled shoulder located in the housing chamber and associated with the second face;

c. at least one hole that passes through the housing flange such that one end of the hole lies outside of the housing chamber and a second end of the hole lies inside the housing chamber;

d. at least one concave ledge associated with the housing inner face;

e. at least one screen carrier having a first end, a second end, and an intermediate portion between the screen carrier first end and the screen carrier second end, wherein the screen carrier intermediate portion is located inside the housing chamber and wherein at least one end of the screen carrier selected from the screen carrier first end and the screen carrier second end passes through the at least one hole in the housing flange such that the at least one screen carrier end is located outside of the housing chamber and wherein an end of the screen carrier selected from the first end and the second end is moveably associated with the housing when the housing is formed; and f. a concave screen associated with the screen carrier intermediate portion, the concave screen including a perimeter that is complementary to at least a portion of the outwardly angled shoulder of the housing flange.

2. The clean-in-place housing of claim 1 wherein the screen carrier intermediate portion is concave.

3. The clean in place housing of claim 2 wherein the screen carrier includes a plurality of intermediate portions located between a first support and a second support.

4. The clean-in-place housing of claim 1 wherein the first end and second end of the screen carrier are each indexable within the at least one hole in the housing flange.

5. The clean-in-place housing of claim 1 wherein the housing includes a first aperture, a second aperture, and an impeller located in the chamber, the impeller including a first end portion that passes through the housing first aperture and second end portion that passes though the housing second aperture.

6. The clean-in-place housing of claim 1 wherein the screen carrier first end is a threaded pin and the screen carrier second end is a threaded pin wherein the first and second screen carrier end threaded pins are located in opposing holes in the housing flange and wherein each of the first and second screen carrier threaded pins are associated with a threaded knob such that the first and second screen carrier treaded pins and associated threaded knobs lie outside of the housing chamber.

7. The clean in place housing of claim 6 wherein the at least one housing flange holes includes a seal.

8. The clean-in-place housing of claim 7 wherein the housing flange hole seal is a wiper lip seal.

9. The clean in place housing of claim 1 wherein the concave screen is tack welded to the screen carrier.

10. The clean in place housing of claim 1 wherein the housing includes a throat chamber including a flange and a processing chamber including a flange wherein the throat chamber flange and processing chamber flange unite to form the housing flange.

11. The clean in place housing of claim 10 wherein a captured gasket is located between the throat chamber flange and the processing chamber flange.

12. The clean-in-place housing of claim 1 wherein the concave screen abuts a bottom face of the concave ledge.

13. The clean-in-place mill housing of claim 1 wherein the processing chamber includes a screen carrier support ledge.

14. The clean-in-place housing of claim 1 wherein the housing flange includes a plurality of holes and wherein both the first end of the screen carrier and the second end of the screen carrier pass through one of the plurality of holes.

15. The clean-in-place housing of claim 1 wherein the housing is formed when a processing chamber is united with a throat chamber.

* * * * *